United States Patent [19]

Clifton, Jr.

[11] Patent Number: 4,807,363

[45] Date of Patent: Feb. 28, 1989

[54] APPARATUS FOR TRIMMING VENETIAN BLINDS

[76] Inventor: Thomas S. Clifton, Jr., 1365 Bailey Dr., Ripon, Calif. 95366

[21] Appl. No.: 98,953

[22] Filed: Sep. 21, 1987

Related U.S. Application Data

[63] Continuation-in-part of Ser. No. 022,055, Mar. 5, 1987, abandoned.

[51] Int. Cl.[4] ..... B26B 13/00

[52] U.S. Cl. ..... 30/242; 30/229

[58] Field of Search ..... 30/229, 242

[56] References Cited

U.S. PATENT DOCUMENTS 4,227,305 10/1980 Newman ..... 30/229

FOREIGN PATENT DOCUMENTS 670345 1/1939 Fed. Rep. of Germany ..... 30/242

*Primary Examiner*—Frank T. Yost
*Assistant Examiner*—Willmon Fridie, Jr.

[57] ABSTRACT

An apparatus for trimming venetian blind slats is provided wherein a hand-held housing carries a removable anvil and blade; the blade is adapted to slide across the anvil, thereby causing a shearing action. The cutting surface of either the anvil or the blade is crowned so that the shearing action begins between the edges of the slat and extends transversely to each edge of the slat. A guide is provided to constrain the blade to a repeatable path across the anvil. The blade is driven by a lever actuated handle which extends longitudinally in a direction parallel to the longitudinal axis of the venetian blind slat. Operation of the handle by the user extends through a linkage connected to the blade to drive the blade across the anvil in a guillotine fashion. The removable blade and anvil can be made of hardened steel. A jig is also provided to facilitate trimming a predetermined amount of material from a plurality of slats.

3 Claims, 2 Drawing Sheets

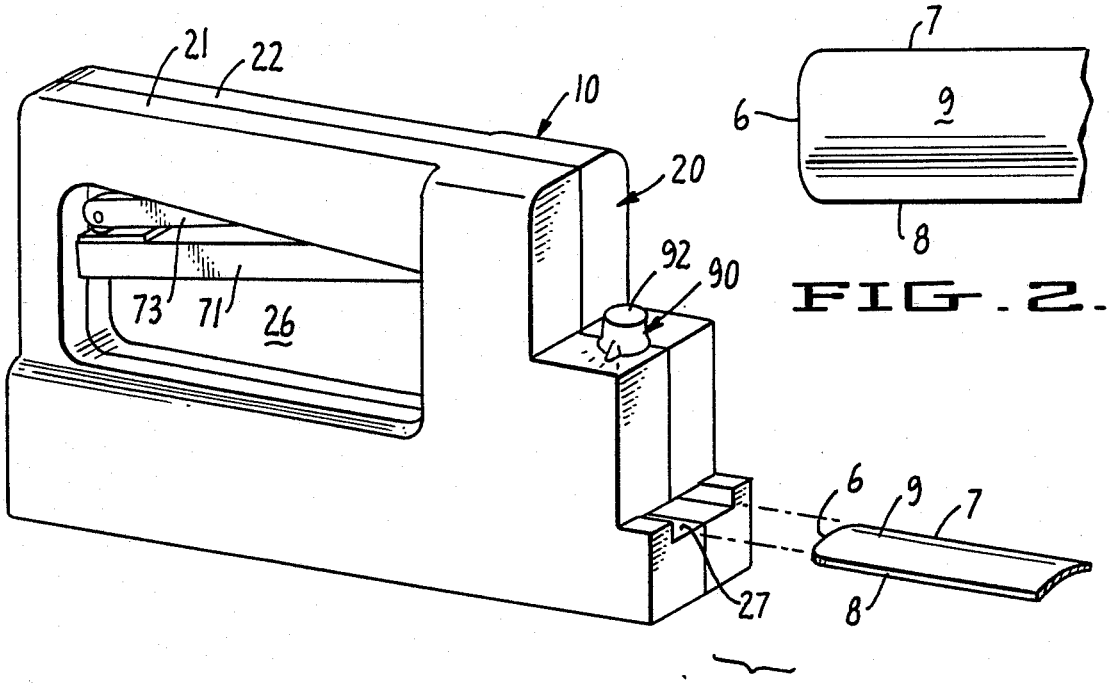
FIG. 2.
FIG. 1.
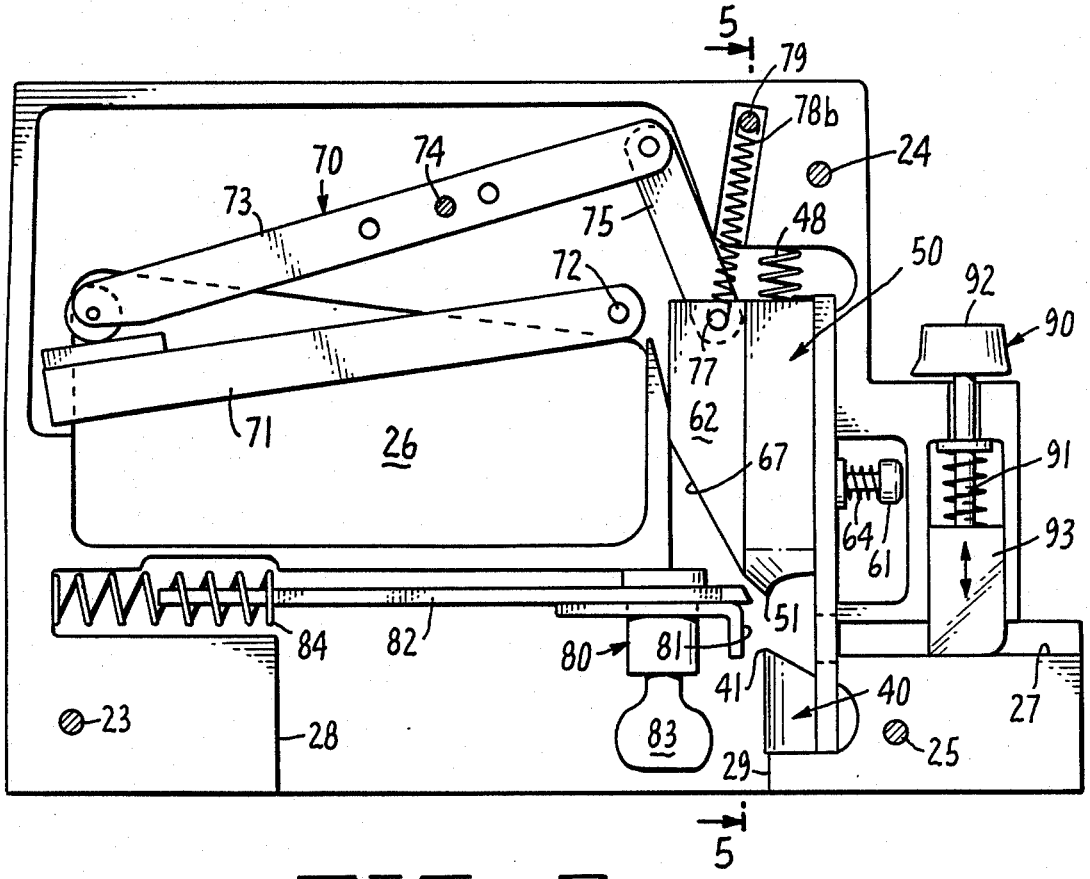
FIG. 3.

APPARATUS FOR TRIMMING VENETIAN BLINDS

CROSS-REFERENCE TO RELATED APPLICATION

This application is a continuation-in-part of application Ser. No. 022,055 filed Mar. 5, 1987 and entitled VENETIAN BLIND TRIMMER, now abandoned.

BRIEF SUMMARY OF THE INVENTION

According to this invention, a hand-held trimmer is provided for shortening standard width venetian blinds to a predetermined width desired by the user.

The custom sizing of venetian blinds traditionally is a timing consuming and rather expensive operation, frequently requiring verification of measurements and requiring a retailer often to send the standard width blind to an outside shop to have the blind sized to the customer's needs. The present invention enables the venetian blind purchaser or the venetian blind retailer to readily trim a standard width blind to the dimensions required by the user.

Accordingly, a primary object of the invention is to provide a venetian blind trimmer which is capable of being hand-held and which can quickly trim a standard width blind to a width desired by the user.

A further object of the invention is to provide a venetian blind trimmer in which a crowned cutting surface is used so that the cutting action begins midway between the edges of a venetian blind slat and thereafter extends transversely towards the edges of the slat.

A further object of the invention is to provide an apparatus for trimming venetian blinds in which a removable blade and anvil are utilized so that, as the cutting surfaces of the blade and anvil are dulled by repeated usage, they may be readily removed and either sharpened or replaced.

A further object of the invention is to provide a hand-held apparatus for trimming venetian blinds in which a housing is provided which surrounds the blade and anvil, so that the device is relatively safe for use by a relatively unskilled or untrained user.

Further objects and advantages of the invention will become apparent to those skilled in the art in light of the following description of the preferred embodiment.

BRIEF DESCRIPTION OF THE DRAWINGS

FIG. 1 is a perspective view of a device incorporating the invention;

FIG. 2 is a plan view of the tip of a typical venetian blind slat;

FIG. 3 is an elevational view of the internal working parts of the apparatus with a portion of the housing cover removed, and with the blade in its upper or retracted position;

DETAILED DESCRIPTION OF THE DRAWINGS

Figure 4:
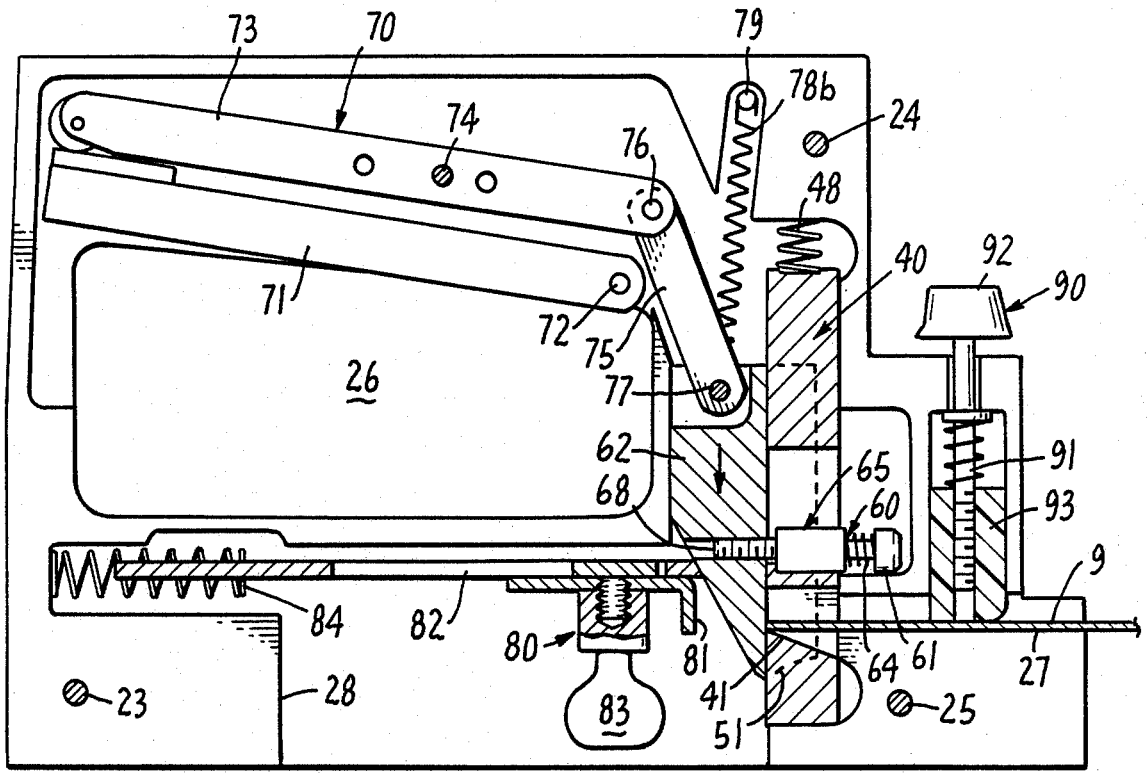
FIG. 4 is a plan view of the internal working parts of the apparatus, shown partially in section, and shown with the blade in its downward position after it has trimmed a portion of a venetian blind slat.

A hand-held apparatus shown generally as 10 is provided for trimming a predetermined portion from venetian blind slat 9 which is elongated, having leading end 6 and parallel edges 7 and 8. Housing 20 is provided, having two mating cover sections 21 and 22 which are connected by threaded bolts 23, 24, 25 as shown best in FIG. 3. Housing 20 has an opening 26 formed therein through which the fingers of the user extend and which allows the user to comfortably hold the apparatus in his or her hand. The cover 26 effectively surrounds the moving parts of the apparatus which will be described below so that the device is relatively safe for untrained and/or unskilled users.

Figure 6:
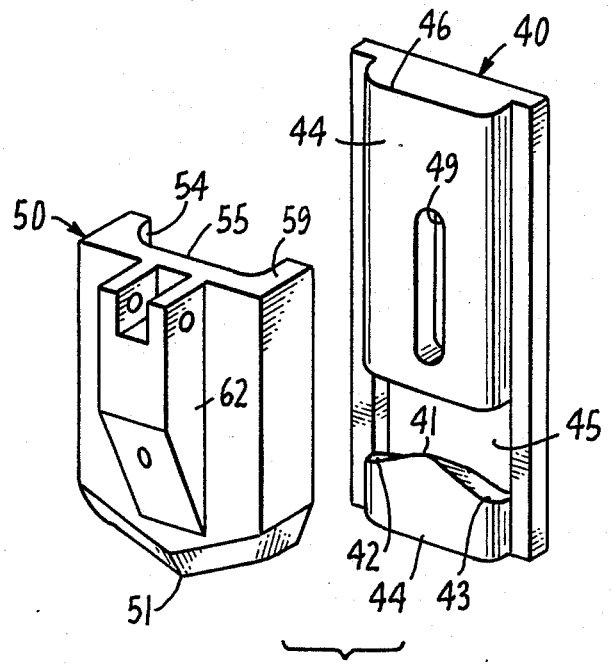
FIG. 6 is a perspective view of the removable blade and anvil portions of the apparatus.

As shown best in FIG. 6, anvil means 40 is provided which may be readily removed from housing 20, simply by unthreading bolts 23, 24, 25 and, after disconnecting minor springs and pins, essentially lifting anvil means 40 from housing 20. Anvil means 40 has a crowned cutting surface 41 which is raised at its center portion so that the center portion 41 makes contact with slat 9 before the outer portions 42 and 43. In this fashion, the shearing action of slat 9 begins between the edges 7 and 8 of the slat and extends transversely to each edge of slat 9. This shearing action tends to hold the slat in a centered position, and avoids crimping the slat as happens when shearing the slat from one edge to the other edge.

Blade means 50, as shown in FIG. 6, is readily removable from housing 20, again by unthreading bolts 23, 24, 25, disconnecting blade means 50 from its connecting points within the apparatus and simply lifting it from housing 20. Blade means 50 has a cutting surface 51 formed at its lower edge which slides across the crowned cutting surface 41 of anvil means 40. As shown in FIG. 5, the cutting surface of blade means 50 is crowned at its center 51 relative to the sides 52 and 53. The preferred embodiment has both the blade means and the anvil means crowned, but the apparatus will operate with either the blade or anvil crowned and the other uncrowned. Blade means 50 is driven upwardly and downwardly in guillotine fashion relative to anvil means 40. The sliding surface 44 of anvil means 40 is smooth and extends both above and below the crowned cutting surface 41, and has an opening 45 formed therein through which venetian blind slat 9 is extended prior to operation of blade means 50. Sliding surface 44 is formed in a predetermined fashion to describe an upper edge 46 which defines the shape of the cut with which venetian blind slat 9 will have after the trimming operation. As shown in FIGS. 1–6, this edge 46 is generally flat across the middle portion with rounded corners at each end. This edge may be semi-circular or of any other desired design. Retaining spring 48 extends from the top of anvil means 40 to housing 20 and stabilizes anvil means 40.

The sliding surface 54 of blade means 50 mates with the sliding surface 44, i.e. surface 54 is essentially identical to surface 44 to provide a smooth shearing action between the cutting edge 51 of blade means 50 and the crowned cutting surface 41 of anvil means 40.

Figure 5:
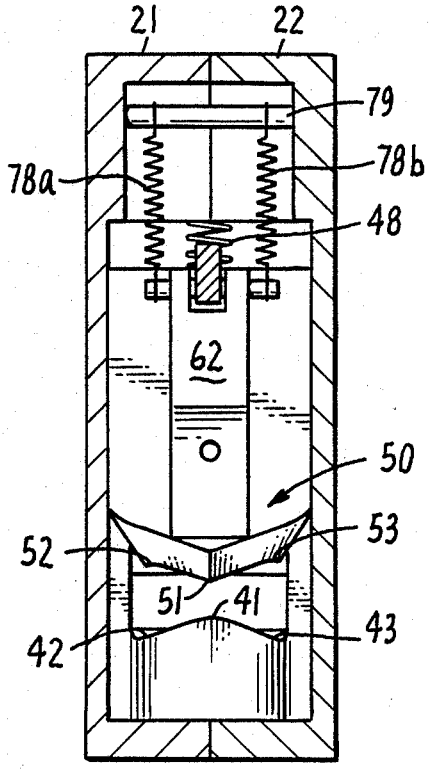
FIG. 5 is a section on the line 5—5 of FIG. 3.

The sliding, guillotine-type motion of blade means 50 relative to anvil means 40 is constrained by guide means 60 shown best in FIG. 4. Guide means 60 includes bolt 61, guide member 62, spring 64, shoulder 65 and slot 49. Threaded bolt 61 extends through slotted opening 49 formed in anvil means 40 and shown best in FIG. 6. Bolt 61 extends through blade means 50, as shown best in FIGS. 3 and 4, and threads into guide member 62 which is carried by blade means 50 as shown best in FIG. 6. The slotted passageway 49 formed in anvil means 40 limits the vertical motion of blade means 50 relative to anvil means 40. Shoulder 65 of bolt 61 has a diameter greater than the threaded end 68 of bolt 61. Shoulder 65 seats against surface 55 of blade means 50 (see FIG. 6). Spring 64 is carried by bolt 61 and exerts pressure between anvil 40 and the head of bolt 61, the strength of spring 64 thereby controlling the shearing pressure between blade means 50 and anvil means 40. Guide means 60 effectively constrains the blade means 50 so that it moves in a repeatable path across the crowned cutting surface 41 of anvil means 40.

Drive means 70 includes a handle 71 which is an elongated bar, the longitudinal axis of which extends parallel to longitudinal axis of slat 9. Handle 71 pivots about pin 72 and, as handle 71 is pulled upwardly from its position shown in FIG. 3 to the position shown in FIG. 4, it drives lever 73, pivoted at pin 74, from its first position shown in FIG. 3 to a second position shown in FIG. 4. A third drive member 75 is pinned to lever 73 by pin 76 and drive member 75 is pinned to guide member 62 at pin 77. Return springs 78*a* and 78*b* extend from pin 77 to pin 79. Guide member 62 is held securely to blade means 50 by the combined action of bolt 61 and shoulder 65. When bolt 61 is threaded firmly into guide member 62, guide member 62 is drawn firmly up against blade means 50, and the pressure with which blade means 50 is pressed against anvil means 40 is determined by the strength of spring 64.

As can be seen from FIGS. 3 and 4, as the user pulls handle 71 upwardly, blade means 50 is driven in guillotine fashion from its retracted position shown in FIG. 3 to its downward position in FIG. 4 wherein the tip 51 of blade means 50 has gone past the crown portion 41 of anvil means 40.

Jig means shown generally as 80 comprises a stop 81 which is positioned so as to bear against the leading end 6 of slat 9 as slat 9 is moved into position to be trimmed. Stop 81 rides in a slot formed in jig support 82 so that stop 81 may be moved from left to right within the housing cavity defined by surfaces 28 and 29. A thumb screw 83 moves with stop 81 so that stop 81 may be positioned at a predetermined distance from the cutting tip 41 of anvil means 40 by tightening thumb screw 83. Jig means 80 thereby provides the user an easy way of trimming a predetermined length off of a plurality of slats. Retaining spring 84 supports the jig support 82 to allow sloping surface 67 of guide member 62 to displace jig means 80 to the left, as shown in FIG. 3, to allow guide member 62 and blade means 50 to move to its downward position shown in FIG. 4 wherein retaining spring 84 is compressed.

Clamp means shown generally as 90 comprises a threaded bolt 91 with head 92 and clamping member 93 which is driven downwardly as shown by the arrows in FIG. 3 to hold venetian blind slat 9 (not shown in FIG. 3) against surface 27 of housing 20 to keep the slat from moving during the trimming process.

In operation, the user simply slides slat onto surface 27, as shown in FIG. 1, and pushes slat 9 across surface 27 until leading edge 6 bears against stop 81 of jig means 80. Stop 81 has been positioned by the user at a predetermined location. The user then tightens clamping means 90 by rotating head 92 in a clockwise direction, thereby clamping slat 9 against surface 27. The user then pulls up on handle 71 which drives the cutting tip 51 of blade means 50 across the crowned cutting surface 41 of anvil means 40, trimming a predetermined length of material off slat 9. The trimmed portion of material simply falls out of the bottom of the apparatus, and the trimmed portion is released from the machine by turning the head 92 of clamping means 90 in a counterclockwise direction and removing slat 9 from the apparatus.

If the user desires to change the blade means and/or anvil means 40, the user simply separates the housing portions 21 and 22 by unthreading bolts 23, 24, 25, and disconnects drive pin 77 and simply lifts the anvil means 40, blade means 50 and guide member 62, along with bolt 61 out of the housing. Since the blade means and handle means are readily removable from the housing, the cutting tip 51 and crowned cutting surface 41 may be hardened to substantially prolong the useful life of the apparatus.

Certain modifications may be made without departing from the spirit of the invention. For example, the upper end 59 of blade means may be sharpened so that blade means 50 can be removed, rotated 180° and guide member 62 reattached. Anvil means 40 can have a second opening like that at 45 formed near its upper end 46 with a second cutting surface.

I claim:

1. Apparatus for trimming venetian blind slats to size, wherein each slat is elongated and has parallel edges, comprising:

a hand-held housing, anvil means removably carried by said housing, blade means removably carried by said housing and adapted to slide across said anvil means, thereby causing a shearing action between said blade means and said anvil means, at least one of said anvil means or said blade means being sufficiently crowned at its center portion so that said crowned center portion contacts the center portion of said slat prior to contacting either edge of said slat being sheared whereby said shearing action begins between said edges of said slat and extends transversely to each edge of said slat, guide means adapted to constrain said blade means so that said blade means moves in a repeatable path across said anvil means, and drive means carried by said housing to cause said blade means to slide across said anvil when actuated by the user, jig means comprising a jig support having a slot formed therein, a stop which rides in said slot and a thumbscrew for positioning said stop to facilitate trimming a predetermined amount of material from one or more of said slats.

2. The apparatus of claim 1 further comprising clamp means carried by said housing to hold said slat during the trimming operation and to prevent both longitudinal and transverse motion of said slat.

3. The apparatus of claim 1 wherein both of said anvil means and blade means are crowned at their center portions so that the shearing of said slat commences at the center of said slat and proceeds to each edge of said slat simultaneously.

* * * * *